United States Patent [19]

Fitzgerald

[11] Patent Number: 4,469,456

[45] Date of Patent: Sep. 4, 1984

[54] DISPOSABLE RIBBON CARRIER FOR A STENOGRAPH REPORTING MACHINE

[76] Inventor: H. Diane Fitzgerald, 395 Nob Hill Dr., Walnut Creek, Calif. 94596

[21] Appl. No.: 305,587

[22] Filed: Sep. 25, 1981

[51] Int. Cl.[3] ..... B41F 1/04

[52] U.S. Cl. ..... 400/194; 400/248

[58] Field of Search ..... 400/91, 92, 248, 248.1, 400/248.2, 194, 207, 208, 234, 247, 202.4, 202.2

[56] References Cited

U.S. PATENT DOCUMENTS

| | | | |
|---|---|---|---|
| 2,387,330 | 10/1945 | Johnson et al. | 400/92 |
| 2,904,157 | 9/1959 | Smith | 400/194 X |
| 3,918,569 | 11/1975 | Parker | 400/202.4 |
| 3,941,231 | 3/1976 | Matuck | 400/248 |
| 4,084,682 | 4/1978 | Fairey et al. | 400/202.4 |
| 4,277,187 | 7/1981 | Rello | 400/248 |
| 4,284,364 | 8/1981 | Rello | 400/248 X |
| 4,290,704 | 9/1981 | Matthias | 400/248 |
| 4,325,645 | 4/1982 | Miyajima et al. | 400/248 X |
| 4,352,575 | 10/1982 | Shore | 400/208 X |

FOREIGN PATENT DOCUMENTS

| | | | |
|---|---|---|---|
| 2019648 | 11/1971 | Fed. Rep. of Germany | 400/248 |
| 472065 | 9/1937 | United Kingdom | 400/247 |

OTHER PUBLICATIONS

"Ribbon Shield with Integral Aligner and Turning Stanchions", IBM Tech. Discl. Bulletin, vol. 22, No. 8A, Jan. 1980, pp. 3071-3072.

*Primary Examiner*—E. H. Eickholt

*Attorney, Agent, or Firm*—Townsend and Townsend

[57] ABSTRACT

A disposable ribbon carrier for use with a stenograph reporting machine having a printing station, an ink spool supporting station and a pair of laterally spaced narrow feed channels normally providing a ribbon transport path between the printing station and the supporting station. The ribbon carrier includes a pair of arm members which extend between the printing station and the supporting station. A central portion joins the end of each arm member adjacent the ink spool supporting station. Each arm member has a first portion diverging outward from the ink spool supporting station toward the printing station, and a second portion extending from the termination of the first portion to a terminating end adjacent the printing station when the ribbon carrier is installed in the reporting machine the second portions being mutually parallel and dimensioned to be received in the narrow ribbon guide channels.

Each arm member also has a ribbon guide for an endless inkable ribbon, selected from several alternate configurations, and a ribbon retaining member at the terminating end. The second portions of the arm members are slightly mutually divergent in the direction of the printing station to provide ribbon tension.

The central portion of the ribbon carrier includes an apertured base wall for receiving a spool support post, an upstanding peripheral wall and a removable closure top member received by the upper margin of the peripheral wall.

16 Claims, 14 Drawing Figures

DISPOSABLE RIBBON CARRIER FOR A STENOGRAPH REPORTING MACHINE

BACKGROUND OF THE INVENTION

This invention relates generally to disposable ink ribbon cartridges for printing mechanisms, and specifically to a disposable ribbon carrier for use with a stenograph reporting machine.

Conventional stenograph reporting machines employ an endless ribbon which is threaded along a feed path in an endless loop, the feed path including a printing station, a ribbon inking station and a pair of narrow stationary guide channels for providing a ribbon transport path from the inking station to the printing station and back. The inking station includes an ink spool having a central hub with a spongy material for retaining liquid ink, the upper wall of the spool having a plurality of ink filling apertures formed therein so that an operator may inject a fresh supply of ink into the spongy ink retaining material through the apertures using an eye dropper. The ink spool is rotatably received on a support post and is designed to be rotated by a conventional gear mechanism in order to transport the ribbon along the ribbon feed path past the printing station and back to the inking station, where fresh ink is transferred from the spongy material to the ink ribbon.

Such ribbons typically wear out after a certain maximum period of use and consequently must be replaced from time to time, the maximum life period of a ribbon depending upon the amount of time that the machine is actually operated. In order to assist in the ink transfer from the spongy spool material to the ribbon surface when the ink has been partially depleted, a pair of mechanically biased pressure rollers are typically located on either side of the ink spool in a pivotal arrangement. The pressure rollers are arranged to be alternately engaged with, or disengaged from, the outer surface of the ink ribbon when the reporting machine is in use, depending on the amount of ink in the spongy spool material.

In order to replace a worn out ribbon, the pressure rollers must be in the retracted position, the spool must be removed from the support post, and the ribbon must be extracted from the feed path. After removal of the old ribbon, a new ribbon is installed using the reverse technique.

The only practical way to remove and old ribbon from stenograph reporting machines of this type is to manually handle the ribbon, which is time consuming, messy and frequently exasperating. In many cases, these disadvantages are exacerbated by the fact that the machine operator is in the process of recording live testimony at trial or at a deposition proceeding, in which case the proceeding must stop until the ribbon can be replaced, all to the consternation of the participants. While the need has long existed for a solution to these problems, efforts to date to design a convenient ribbon replacement device for such machines have not met with success.

SUMMARY OF THE INVENTION

The invention comprises a disposable ribbon carrier especially designed for use with a stenograph reporting machine having a printing station, and ink spool supporting station and a pair of laterally spaced narrow feed channels normally providing a ribbon transport path between the printing station and the supporting station.

The ribbon carrier includes a pair of arm members extending between the printing station and the supporting station and a central portion joining the ends of each of the pair of arm members in the region adjacent the ink spool supporting station. Each arm member includes a first portion diverging outwardly in the direction away from the ink spool supporting station toward the printing station, and a second portion extending from the termination of the first portion to a terminating location adjacent the printing station when the ribbon carrier is installed in the reporting machine. The second portions are substantially mutually parallel and are dimensioned to be received in the narrow ribbon guide channels when the carrier is installed.

Each arm member includes a ribbon guide means for an endless inkable ribbon received by the ribbon guide means in the arm members.

The second portions of the arm members are preferably slightly mutually divergent in the direction of the printing station in order to provide tension for the inkable ribbon in the vicinity of the printing station between the terminating locations of each of the second portions.

The central portion of the ribbon carrier includes a base wall and an upstanding peripheral wall for providing a receptacle for the ink spool, the base wall having a central aperture for receiving a spool support post. The carrier may further include a removable closure top member dimensioned to be received by the upper margin of the peripheral wall so as to normally contain the ink spool within the receptacle, while enabling access to the interior of the receptacle when re-inking of the spool is required.

Several alternate embodiments of the arm members are provided. In a first embodiment, the arm members each have a u-shaped cross sectioned geometrical configuration, and the ribbon guide means in such an embodiment comprises the inner surfaces of the arm members, the arm members opening either upwardly or downwardly. In other embodiments, the arm members each comprise a longitudinally extending generally flat strip. In such embodiments, the ribbon guide means alternately comprises a plurality of retainers spaced along the inner or outer surface of the flat strip, each retainer spanning a dimension between the top and bottom edges of the strip sufficient to accomodate and capture the ribbon; a pair of re-entrant flanges extending along the top and bottom edges of the strip and located on either the outer surface or the inner surface of the strip; or a longitudinally extending channel formed along the outer surface of the strip.

To ensure proper retention of the ribbon in the region adjacent the printing station, each arm member is preferably provided with a ribbon retaining member located at the terminating location of the second portion, the ribbon retaining member comprising a C-shaped terminating end portion.

The entire carrier can be fabricated from low cost molded plastic material and, in an alternate embodiment, the ink spool may also be fabricated from molded plastic material and included as part of the entire assembly. The carrier is designed to be quickly and easily installed or removed, without the necessity of the operator ever touching the ribbon.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
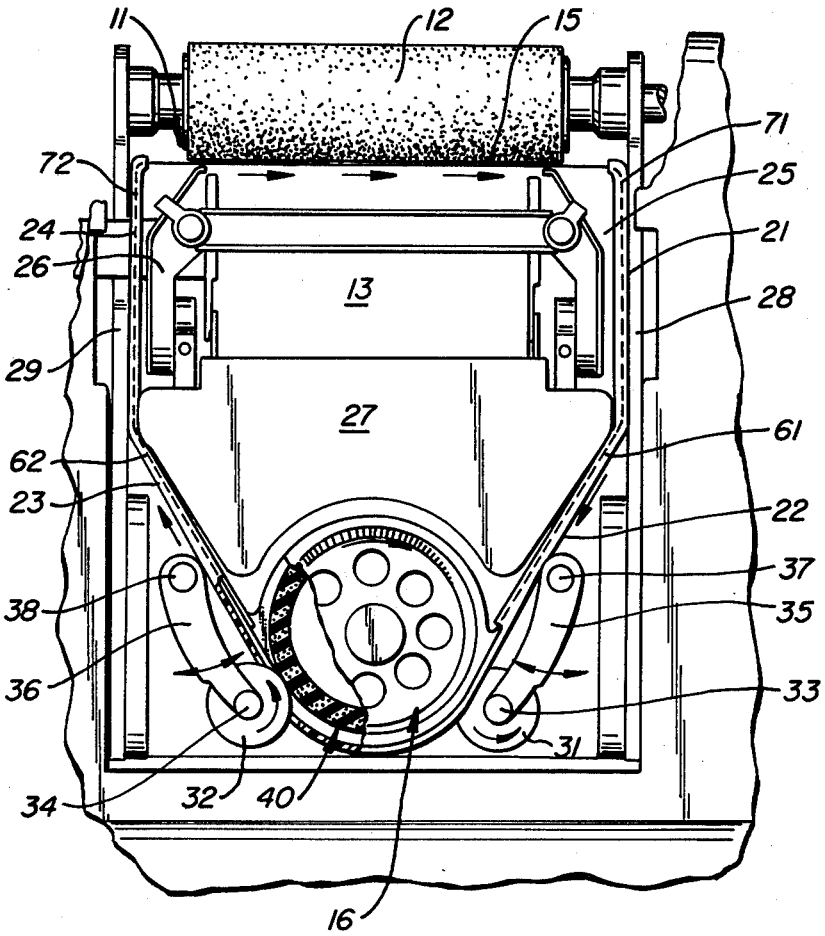
FIG. 1 is a top plan view, partially broken away, showing the invention installed in a stenograph reporting machine.

Turning now to the drawings, FIG. 1 is a top plan view of a portion of a stenograph recording machine showing the invention installed, the lower left-hand corner of the invention being partially broken away to illustrate certain mechanical details. As seen in this figure, the printing mechanism of a stenograph reporting machine, which is usually located at the top rear portion of the machine, includes a printing station generally designated with reference numeral 11. The printing station includes a pressure roller/platen 12 to which the print medium is fed from below, and a type bar housing section 13 in which individual type bar elements are located. In use, in response to the manipulation of a particular keyboard character key (not shown) a type bar element emerges from the housing section 13 and impresses a portion of endless inked ribbon 15 against the print medium supported by the platen 12.

The ribbon 15 is an endless ribbon which extends in a path from the printing station 11 in a clockwise direction to an inking station generally designated by reference numeral 16, and back to the printing station 11. The ribbon feed path includes relatively narrow side channel portions 21–24 defined by stationary side wall portions 25, 26 of the type bar housing section 13, mounting plate 27, and the inner surface of vertically extending side wall portions 28, 29 of the printing mechanism housing.

Ribbon 15 is translated along the ribbon feed path in the direction of the arrows by means of a frictional force between the ribbon 15 and a rotatable ink spool generally designated by reference numeral 40, the force being provided by tension in the ribbon 15. A pair of pressure rollers 31, 32 mounted on shafts 33,34 carried by mounting arms 35, 36, which are pivotally mounted on shafts 37,38, are also included for the purpose of providing additional pressure between the ribbon 15 and the ink spool 40 as ink is depleted from the spool 40.

Figure 3:
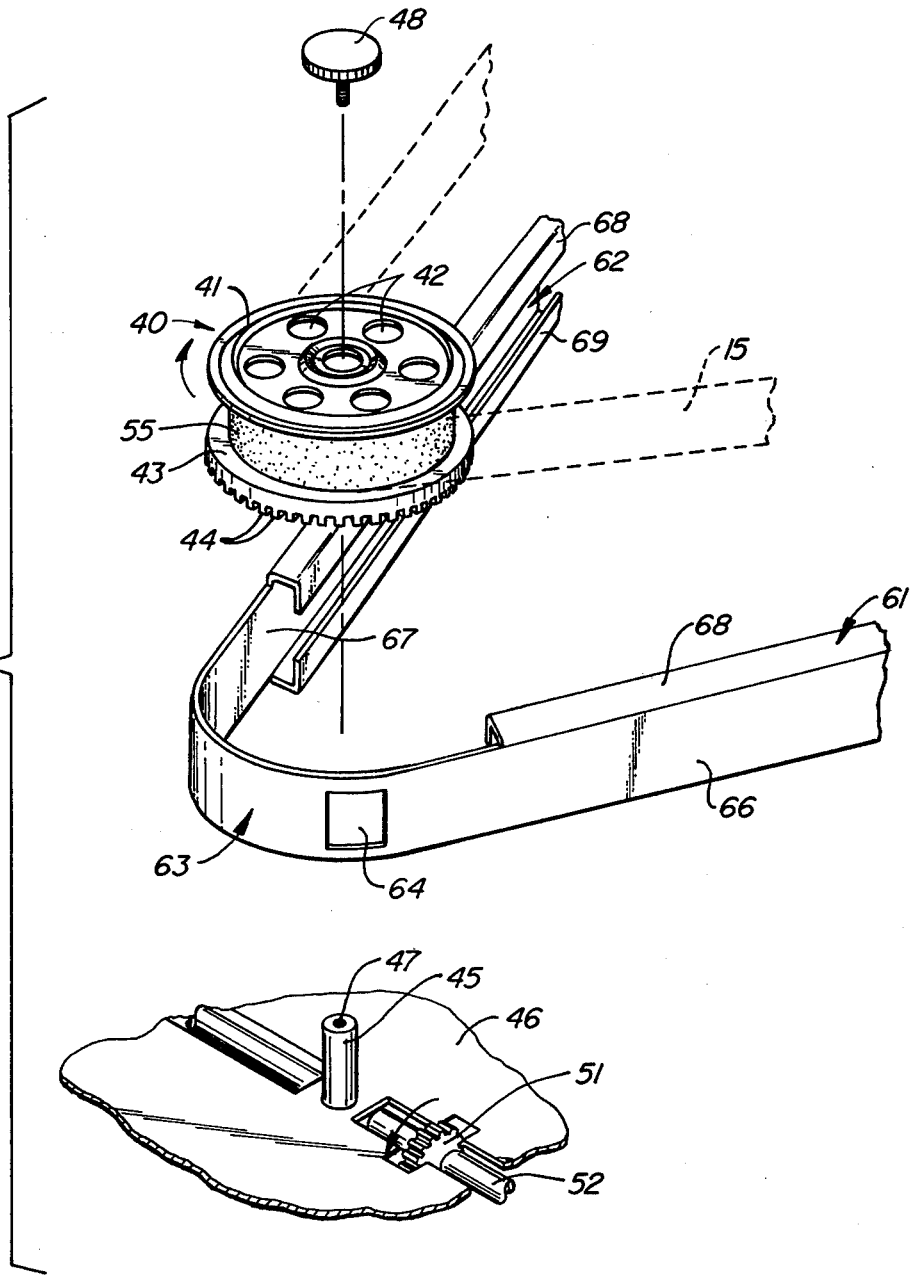
FIG. 3 is an exploded schematic view showing the relationship between a first embodiment of the carrier, the ink spool and the spool drive mechanism.

As best seen in FIG. 3, ink spool 40 includes an upper flanged portion 41 having a plurality of apertures 42, and a lower flanged portion 43 provided with a plurality of gear teeth 44. The ink spool is supported by a post 45 secured to a mounting plate 46, post 45 having an internally threaded bore 47 for receiving the externally threaded shaft portion of a set screw 48, so that spool 40 is rotatably retained on post 45 in an essentially horizontal attitude by cooperation between set screw 48 and post 45.

A drive gear 51 mounted for rotation in the direction indicated by the arrow on a drive shaft 52 engages the gear teeth 44 on spool 40 to provide a mechanical driving force to rotate spool 40 in the direction indicated by the adjacent arrow. This rotational motion is normally frictionally imparted to ribbon 15 by the tension of ribbon 15 in cooperation with the spool 40.

Figure 5:
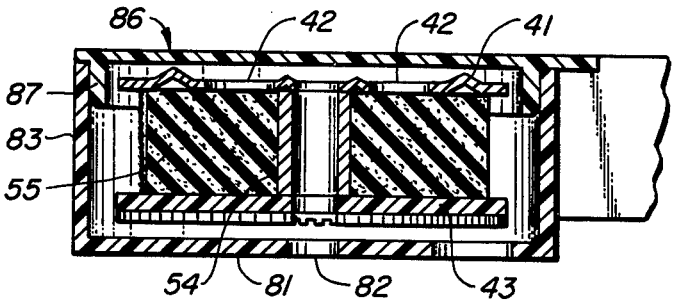
FIG. 5 is a sectional view taken along lines 5—5 of FIG. 4.

With reference to FIG. 5, spool 40 includes an apertured hub portion 54 which is surrounded by an ink retaining substance, such as a sponge rubber annulus 55. Annulus 55 is accessible via the apertures 42 and serves as an ink reservoir and ink transfer medium for the ribbon 15.

The disposable ribbon carrier constructed according to the invention is shown in partial exploded perspective view in FIG. 3 and includes complementary arm members having first portions 61, 62 joined in the region adjacent the inking station 16 by means of a central portion 63 having a radius of curvature comformable to the curvature of the spool 40 flange portions. Central portion 63 is also provided with a pair of apertures 64 (only one of which is visible in FIG. 3) for the purpose of accomodating pressure rollers 31, 32. Each first portion of the arm member 61, 62 comprises a longitudinally extending generally flat strip 66, 67 having a pair of reentrant flanges 68, 69 extending along the top and bottom edges of the strip for providing a guide channel for the ribbon 15 in the region between the inking station 16 and the printing station 11. Each arm member includes a second portion schematically depicted in FIG. 1 and designated with reference numerals 71, 72 portions 71, 72 being substantially mutually parallel and terminating adjacent opposite ends of the printing station 11. Although depicted as substantially mutually parallel, preferably second portions 71, 72 diverge slightly in the direction from the inking station 16 to the printing station 11, in order to provide tension for the ribbon, particularly in the printing region between the terminating ends of portions 71, 72.

In the embodiment of FIG. 3, with the ribbon 15 positioned in the guide channels afforded by the facing flanges 68, 69, the ribbon carrier is installed in the reporting machine by first removing the spool 40 from the post 45, locating ribbon 15 along the surface of spongy material 55 to slightly tension the ribbon between the terminating ends of arm portions 71, 72, moving the open end of the carrier downwardly so that the ribbon 15 is positioned between the printing station 11 and the platen 12 while holding the spool 40 against the inner surface portion 63, and manipulating the carrier downwardly so that the arm portions 71, 72 are first received in the narrow channels 21, 24, after which the arm portions 66, 67 are received in their respective narrow channels 22, 23 and spool 40 is positioned on post 45. After the carrier has been thus positioned, the set screw 48 is reattached to post 45. Removal of the ribbon carrier is accomplished in the reverse fashion.

Figure 4:
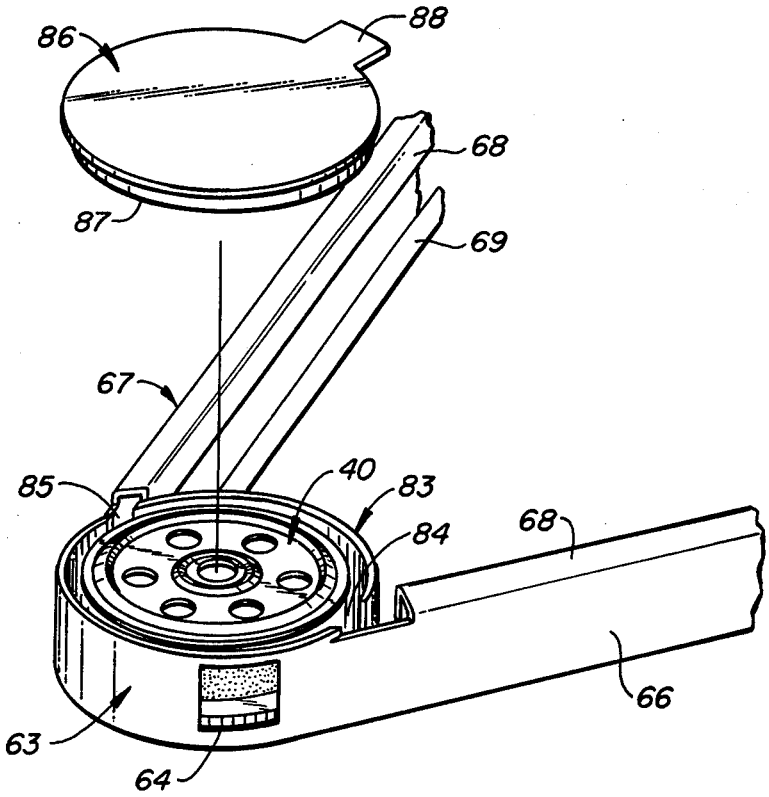
FIG. 4 is an exploded schematic view illustrating an alternate embodiment of the invention.

FIGS. 4 and 5 illustrate an alternate embodiment of the invention in which the spool 40 is mechanically carried by and retained with the ribbon carrier. As seen in these Figs., central portion 63 includes a base wall 81 having an aperture 82 for receiving the spool support post 45, and an upstanding sidewall portion 83 defining a cylindrical cavity in which the spool 40 is received. Wall 83 is slotted at locations designated by reference numerals 84, 85 so that the ribbon 15 may enter the spool receptacle region via slot 84, pass partially around the spool 40 and exit via slot 85 to arm portion 67. Preferably, a removable closure cap 86 is included in the assembly, the cap 86 having a downwardly extending flange portion 87 dimensioned to be frictionally received by side wall 83 in order to retain spool 40 in the spool receptacle during storage, insertion and removal. Cap 86 is provided with a gripping tab portion 88 to facilitate removal of the cap.

The embodiments of FIGS. 4 and 5 can be installed in the stenograph reporting machine in a manner similar to that described above with reference to FIG. 3. However, the embodiment of FIGS. 4 and 5 is much more convenient to install and remove since it is not necessary to separately support the spool 40 during installation and removal of the carrier-ribbon assembly.

Figure 2A:
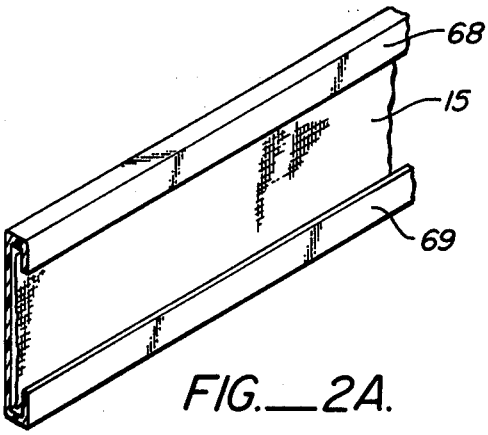
FIGS. 2A–2H illustrate alternate configurations of the carrier arm members.
Figure 2B:
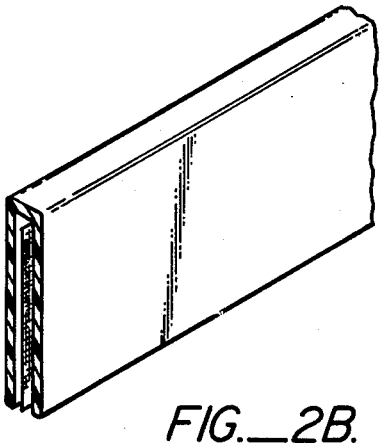
Figure 2C:
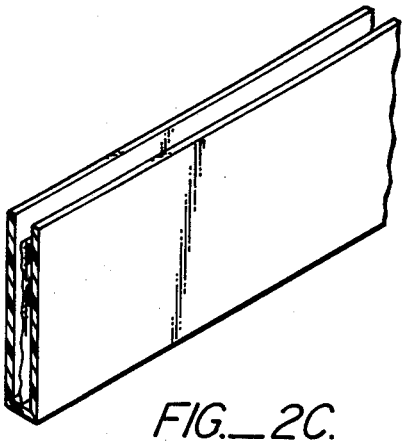
Figure 2D:
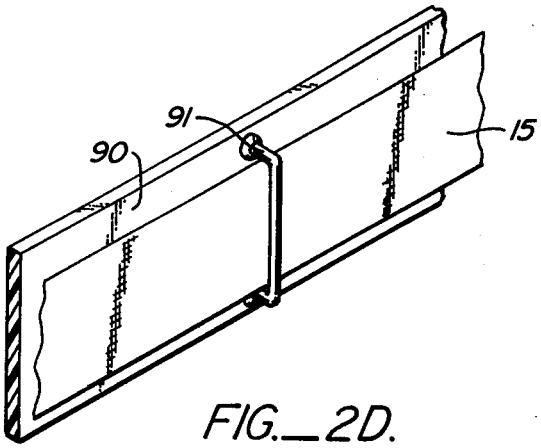
Figure 2H:
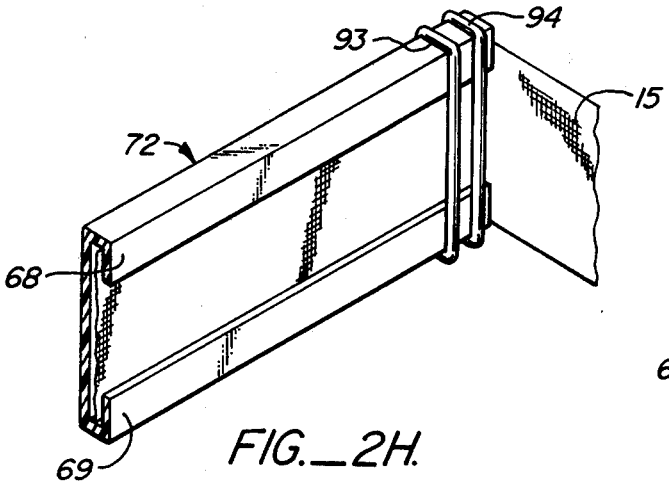

The cross sectional geometrical configuration of the carrier arms may take on several different forms. Thus, for example, in addition to the flanged arrangement described above with reference to FIG. 3 and shown in partial view (FIG. 2A), the arm may comprise a downwardly opening u-shaped cross section (FIG. 2B), or an upwardly opening u-shaped configuration (FIG. 2C). In addition, the arm may consist of a longitudinally extending generally fat strip as shown in FIGS. 2D and 2E, with the ribbon guide function being provided by retainers, such as retainer 91 (FIG. 2D), secured to either the inner or outer side surface of the strip. The retainers may comprise u-shaped wire rods secured as shown to the strip 90 by any suitable means, such as press fitting, heat staking or the like. Alternatively, the ribbon guide function may be provided by forming a longitudinal slot 92 along the outer surface of the arms (FIG. 2F).

Figure 2G:
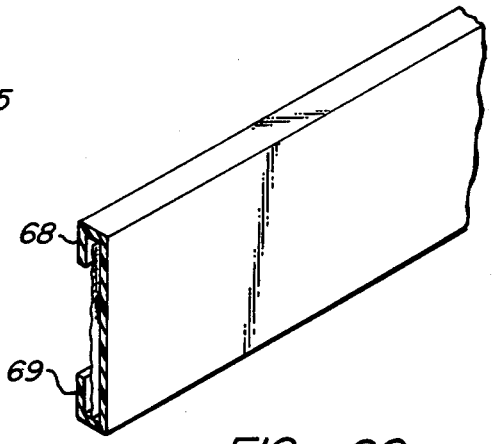
Figure 2E:
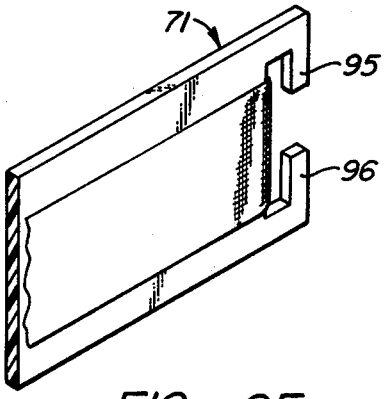
Figure 2F:
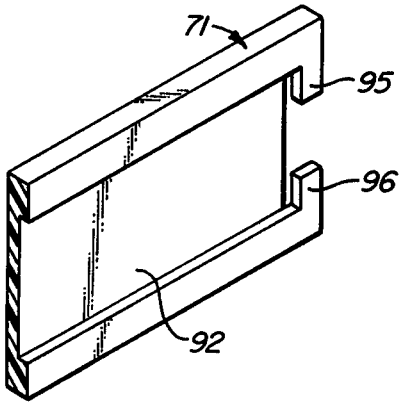

In addition, it should be noted that the arms may be configured with the flanges 68, 69 located on either the inner surface of the carrier (FIG. 2A) or along the outer surface (FIG. 2G).

If desired, the second portions 71, 72 of the carrier arms may be provided with a ribbon guide at the terminating end, such as guides 93, 94 (FIG. 2H), or guides 95, 96 (FIGS. 2E and 2F) in order to fully enclose the channel in the region between the flange surfaces and ensure that the ribbon 15, when under tension will not pull out of the channel.

Figure 3A:
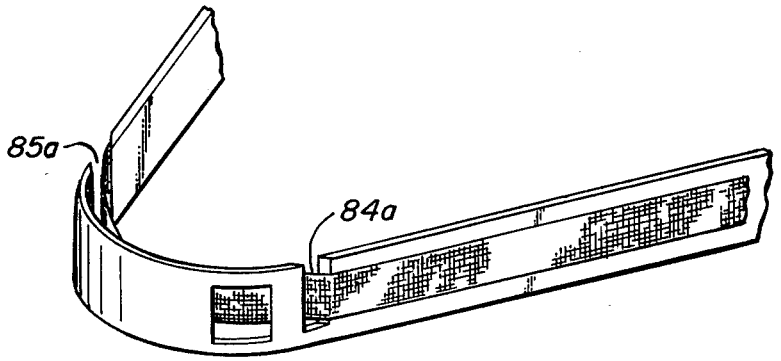
FIG. 3A is a partial view of a modification of the FIG. 3 embodiment.
Figure 4A:
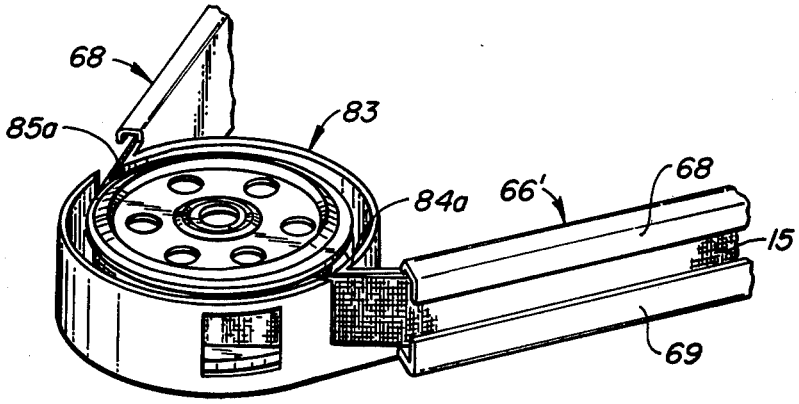
FIG. 4A is a partial view of a modification of the FIG. 4 embodiment.

For those embodiments in which the path of ribbon 15 is along the outer surfaces of the carrier arms (FIGS. 2D, 2E, 2F and 2G), provision must be made for enabling the ribbon 15 to pass from the outer surface of the arms to the inner surface of the carrier in the spool region. Thus, in the non-spool containing embodiment of the carrier (FIG. 3A), slots 84*a* and 85*a* are provided for this purpose. Similarly, in the spool containing embodiment (FIG. 4A) slots 84*a* and 85*a* are included.

The carrier is preferably fabricated by molding from a suitable plastic material to any of the alternate shapes disclosed herein. The material should provide a relatively stiff construction, while at the same time allowing the arms 66, 67, 71, 72 to be flexed with respect to one another to facilitate insertion and removal of the carrier from the reporting machine. In addition, in the embodiment of FIGS. 4 and 5, the spool may likewise be molded from a suitable plastic material of sufficient strength to withstand the driving force of the gear 51.

As will now be apparent, the invention enables a stenograph reporting machine operator to quickly and cleanly replace a worn out ribbon without having to manipulate the ribbon per se. Moreover, carriers constructed according to the invention are extremely inexpensive to manufacture, and are thus truly disposable.

While the above provides a full and complete disclosure of the preferred embodiments of the invention, various modifications, alternate constructions and equivalents may be employed without departing from the true spirit and scope of the invention. For example, while closure cap 86 has been depicted with a flange configured to engage the inner surface of wall 83 of central portion 63, this flange may be designed to grip the outer surface of wall 83. In addition, wall 83 may be provided with a peripheral ridge adjacent the top edge thereof, in order to provide a more positive locking action for cap 86. Moreover, the lower surface of closure cap 86, the upper surface of base wall 81, or both may be provided with a locating boss for the central aperture of spool 40 in order to mechanically center the spool during storage and insertion. Therefore, the above description and illustrations should not be construed as limiting the scope of the invention, which is defined by the appended claims.

What is claimed is:

1. A disposable ribbon carrier for use with a stenograph reporting machine having a printing station, a supporting station for a rotatable ink spool having a ribbon engaging surface, at least one retractable pressure roller adjacent said supporting station for urging an inkable ribbon against the surface of said ink spool, and a pair of laterally spaced narrow feed channels normally providing a ribbon transport path for said inkable ribbon between said printing station and said supporting station, said ribbon carrier comprising:

a pair of essentially rigid ribbon guide members between said printing station and said supporting station; and a central portion joining the ends of each said pair of ribbon guide members in the region adjacent said supporting station with sufficient rigidity to provide a tensioning force for said endless inkable ribbon in combination with said ribbon engaging surface of the ink spool;

said central portion being dimensioned to accommodate the outer periphery of said ink spool within the interior thereof so that said ink spool can be received interior to said central portion;

said central portion being relieved in the region of said pressure roller to provide access to said ribbon by said roller, said ribbon guide members each having a first portion diverging outwardly in the direction away from said supporting station toward said printing station and a second portion extending from the termination of the first portion to a terminating location adjacent said printing station when said carrier is installed in said reporting machine, the second portions being substantially mutually parallel;

said second portions being dimensioned to be removably received in said narrow feed channels when said carrier is installed in said machine.

2. The apparatus of claim 1 wherein said second portions are slightly mutually divergent in the direction of said printing station to provide optimal tension for said inkable ribbon in the vicinity of said printing station between the terminating locations of each said second portion.

3. The apparatus of claim 1 wherein said central portion of said ribbon carrier includes a base wall and an upstanding peripheral wall for providing a receptacle for the ink spool, said base wall having a central aperture adapted to receive a spool support post.

4. The apparatus of claim 3 wherein said carrier further includes a removable closure top member dimensioned to be received by the upper margin of said peripheral wall.

5. The apparatus of claim 1 wherein said ribbon guide members each have a u-shaped cross sectioned geometrical configuration.

6. The apparatus of claim 5 wherein said u-shaped cross sectioned geometrical configuration opens downwardly.

7. The apparatus of claim 1 wherein said u-shaped cross sectioned geometrical configuration opens upwardly.

8. The apparatus of claim 1 wherein said ribbon guide members each comprises a longitudinally extending generally flat strip, the outer surface of said strip providing a guide surface for said ribbon.

9. The apparatus of claim 8 wherein the first and second portions of said strip are joined at an obtuse angle.

10. The apparatus of claim 8 wherein said ribbon guide members each include a plurality of retainers spaced along said flat strip, each retainer spanning a dimension between the top and bottom edges of said strip sufficient to accommodate said ribbon.

11. The apparatus of claim 8 wherein said ribbon guide members each includes a longitudinally extending channel formed in the outer surface of said strip.

12. The apparatus of claim 8 wherein said ribbon guide members each includes a pair of re-entrant flanges extending along the top and bottom edges of said strip.

13. The apparatus of claim 12 wherein said flanges are positioned adjacent the inner surface of said strip.

14. The apparatus of claim 12 wherein said flanges are positioned adjacent the outer surface of said strip.

15. The apparatus of claim 1 wherein said pair of ribbon guide members each includes a ribbon retaining member located at the terminating location of each said second portion.

16. The apparatus of claim 15 wherein said ribbon retaining member comprises a c-shaped terminating end portion.

* * * * *